US006023873A

United States Patent [19]

Baird

[11] Patent Number: 6,023,873

[45] **Date of Patent: *Feb. 15, 2000**

[54] GUN BARREL CLEANER

[76] Inventor: Ian Franklin Baird, P.O. Box 1791, Julian, Calif. 92036

[ * ] Notice: This patent is subject to a terminal disclaimer.

[21] Appl. No.: 09/111,624

[22] Filed: Jul. 7, 1998

Related U.S. Application Data

[63] Continuation-in-part of application No. 08/777,269, Dec. 31, 1996, Pat. No. 5,775,020.

[51] Int. Cl.[7] ..... F41A 29/02

[52] U.S. Cl. ..... 42/95; 15/88; 15/104.16

[58] Field of Search ..... 42/95, 96; 15/88, 15/104.165, 104.16, 104.2

[56] References Cited

U.S. PATENT DOCUMENTS

| | | | |
|---|---|---|---|
| 268,004 | 11/1882 | Davis | 42/95 |
| 464,843 | 12/1891 | Bagger | 42/95 |
| 1,552,994 | 9/1925 | Lindeman | 15/104.165 |
| 3,814,525 | 6/1974 | Spencer | 15/104.165 |
| 5,245,777 | 9/1993 | Neuman et al. | 42/95 |
| 5,379,542 | 1/1995 | Guzman | 42/95 |
| 5,402,548 | 4/1995 | Adair et al. | 15/88 |

FOREIGN PATENT DOCUMENTS

| | | | |
|---|---|---|---|
| 4024541 | 2/1992 | Germany | 42/95 |

*Primary Examiner*—Stephen M. Johnson
*Attorney, Agent, or Firm*—Stephen Donovan

[57] ABSTRACT

A gun bore cleaning system, comprising a cleaning rod with a chamber in handle to accept a capsule of cleaning fluid with a manually operable, resiliant pressure/suction pump with a capability to control and dispense fluid through a hollow rod. An attached swivel end/check-valve allows free end tip rotation and prevents leakage from rod member. Also included with the system is a "capture boot" that temporarily mounts to a guns' barrel for collecting all spent fluid.

9 Claims, 2 Drawing Sheets

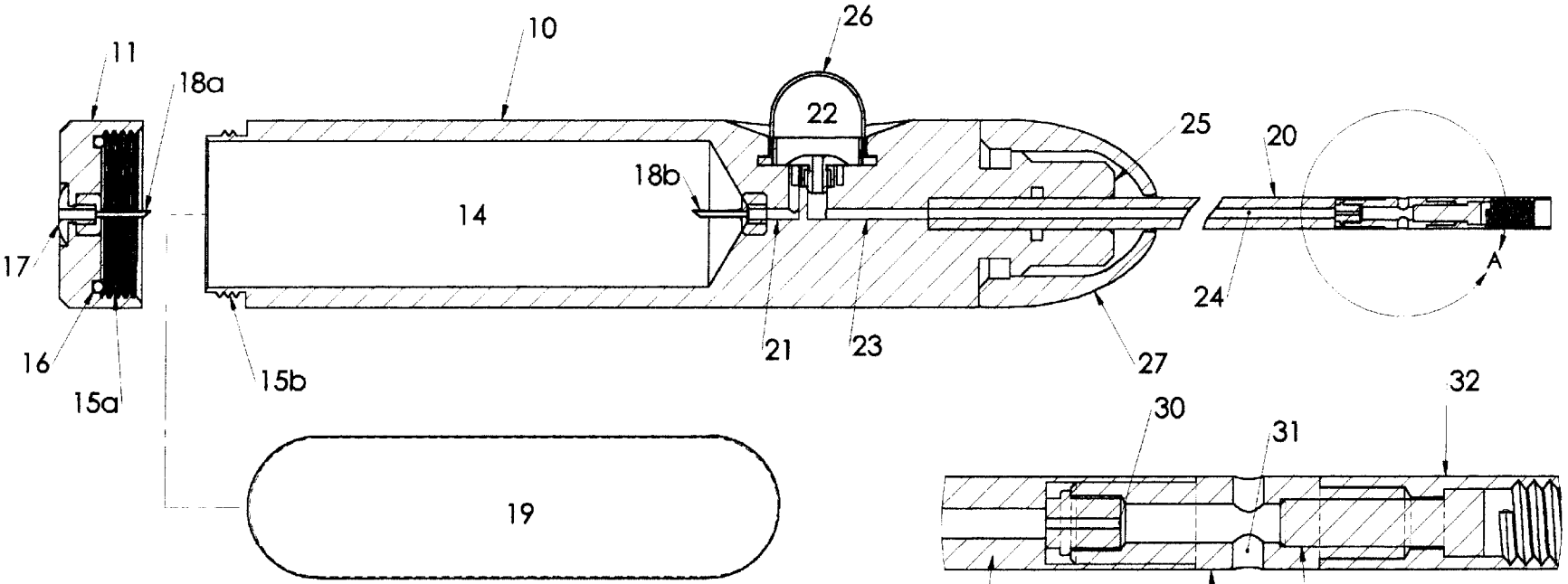
FIGURE 1
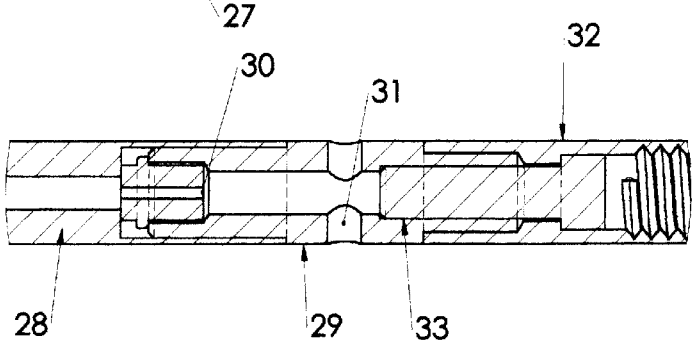
FIGURE 1A
FIGURE 1B

GUN BARREL CLEANER

CROSS REFERENCE

This application is a continuation in part of application Ser. No. 08/777,269, filed Dec. 31, 1996, now U.S. Pat. No. 5,775,020.

FIELD OF INVENTION

This invention relates generally to a gun cleaning system, and more particularity is directed towards a gun cleaning rod which dispenses a cleaning solvent and a "Capture Boot" to collect and contain the used cleaning solvent.

BACKGROUND OF INVENTION

The current process involved in cleaning a bore of a gun is dipping the attached brush, swab, or jag (common gun barrel cleaners), located at rods' end into a container of cleaning solution and proceeding to insert into guns' bore. Dripping of solution immediately occurs contaminating all that's in it's path before entering the bore of the barrel. Another foreseen problem is the "tip-over" condition, since the length of the rod is considerably greater than the size of the solution container an unstable condition exists, when trying to aim the brush into the mouth of the cleaning solution container. Under the best of circumstances, if spillage was kept minimal before entering the guns' bore, during the cleaning process of scrubbing bore, solution with contaminants flow out or worse yet "flung out" upon exiting second end of bore. The gun barrel bore having a first end and second end. This fling of contaminated solution permeates the air and surrounding area causing clean-up problems as well as health problems. Accordingly, it is an object of the present invention to provide a self contained, safe and reliable mechanism to not only distribute cleaning fluid, but also to capture and contain the contaminated fluid for recycling or safe disposal.

Thus there is a need for a gun cleaning system that would be relatively inexpensive to manufacture and would also be easy to operate. The present invention fulfills these needs and provides further related advantages.

SUMMARY OF INVENTION

It has now been discovered that the above and other objects of the present invention may be accomplished in the following manner. One object of the invention comprises an improved gun cleaning rod. The present device includes a hollow handle with chamber for accepting a capsule of cleaning solution for a quick, clean and safe means of loading. A removable, leak proof cap encloses chamber and ensures containment of cleaning solution. Included in cap is a self piercing needle for puncturing the wall membrane of capsule, after placement in chamber. Adjacent and in communication with the self piercing needle in the cap is a check-valve that maintains equalized airpressure while preventing loss of fluid. A self piercing needle centered axially in the inner bottom of chamber in handle, punctures frontal capsule membrane upon loading, allowing fluid to pass into the suction line. A manually operated suction/pressure pump located on handle between the suction line and discharge line extracts and delivers the quantity of fluid to the hollow rod by intermittent pressing then releasing of pumps resilient dome. Opposite end of the handle cap is an inserted hollow rod, constructed in varying lengths and diameters so as to accommodate like sizes of bores. The hollow rod passes through a frontal bumper guard made of a rubber like substance to absorb any shock or cause any harm if contact is made. This guard is opposite to the handle cap and attached to the handle nose piece. The fluid forced by the pumps pressure is delivered through the longitudinal bore of the hollow rod where contact is made with a check-valve that insures complete containment of fluid within the bore, without leakage. The bore of the hollow rod, now filled to capacity, by exerting more fluid pressure forces the check-valve to open momentarily, allowing passage of fluid, then closing when pressure subsides. Once fluid passes the check-valve it enters the fluid channel of the affixed embodiment to the hollow rod. An opening in the walls to connecting fluid channel in the affixed embodiment provides means for dispensing the fluid into the guns bore. The swivel end tip of the affixed embodiment allows attachment of generic type cleaning tips such as brushes, swabs, and jags, to freely rotate in relation to the hollow rod. This allows tips to follow the groves and rifling as the rod is pushed then pulled through the guns bore.

The collector or "capture boot" is a device that is temporarily mounted to the gun barrels' end. The gun barrel having a first end and a second end. Made of a solvent resistant material, the orfice can stretch to accommodate various sizes of barrel diameters. As the cleaning rod is pushed through the barrel, any and all fluid and debris is spilled and captured by this boot to be properly disposed of or recycled. Other features and advantages of the present invention will become apparent from the following and more detailed description, taken in conduction with the accompanying drawings which illustrate by way of example, the principles of the invention.

DRAWINGS

FIGS. 1–1B is a exploded, longitudinal cross-sectional view of a preferred embodiment of a gun barrel cleaner within the scope of the invention disclosed herein;

FIG. 1A is an enlarged view of a front portion of the gun barrel cleaner illustrated by FIG. 1, and;

DETAILED DESCRIPTION OF THE PREFERRED EMBODIMENT

Figure 2:
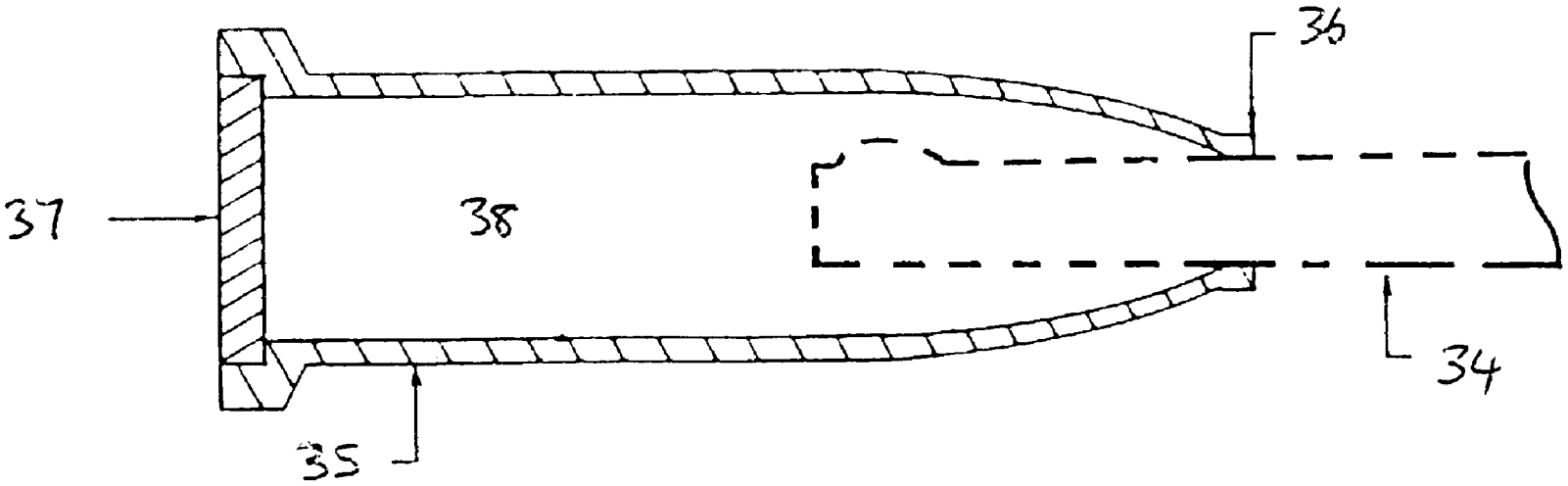
FIG. 2 is a longitudinal cross-section of a fluid collector which can be used in conjunction with the gun barrel cleaner illustrated by FIG. 1.

Referring to FIG. 1, One embodiment of the present invention includes a hollow handle 10 with a chamber 14 that accepts a capsule 19 of cleaning fluid. 11 is the removable cap which allows access into the chamber 14. Upon loading the chamber 14 with a capsule 19 by securing the cap 11 in place by mating threads 15A and 15B respectively the wall membrane of the capsule 19 is simultaneously pierced by self piercing needles 18A and 18B. The solvent resistant o-ring 16 attached to the cap 11 insures a leakproof chamber 14 after securing cap 11. Centered axially in the cap 11 a self piercing needle 18A protrudes from inside to communicate through caps 11 wall with a check-valve 17 centered axially on outside of cap 11, held by a press fit. This union supplies equalized air pressure into the capsule 19 to displace the volume of extracted fluid by the self piercing needle 18B. A manually operated suction/ pressure pump 22 with a resilent dome 26 draws fluid through suction line 21 into the pump 22 and out into the discharge line 23.The pump 22 is located between the suction line 21 and discharge line 23. on the hollow handle 10. The fluid from discharge line 23 enters the bore 24 of the hollow rod 20 that is inserted into the nose piece 25. The nose piece 25 is opposite to cap 11 on the hollow handle 10. The nose piece 25 supports the bumper guard 27 made of a rubber like material. As fluid fills the bore 24 a check-valve 28 stops leakage until pressure is applied forcing past check-valve 28 the fluid enters a fluid channel 30 that passes through an affixed embodiment 29 attached to the end of the hollow rod 20. The affixed embodiment 29 fluid channel 30 provides an opening or port 31 in the walls for fluid to wet the attached tip. The swivel end tip 32 is threaded and accommodates all generic type cleaning tips. This swivel end tip 32 freely rotates on the bottoming screw 33 upper collar or neck and so attaches to the affixed embodiment 29 by bottoming threads.

FIG 2 shows a gun barrel 34 (not part of the invention) with a cleaning solvent or fluid collector 35 held securely on a gun barrel by placing an open end 36 of the fluid collector 35 over the gun barrel 34. When solvent exits fluid channel 30 on FIG. 1, the fluid can passes down through the gun barrel 34 to be collected in the fluid collector 35 and thereby captured for recycling the solvent. An end cap 37 on one end of the fluid collector 35 permits access to the cavity 38.

LOG

10. Hollow handle
11. Removable cap
14. Chamber
15.*a* Capthreads
15.*b* Handle threads
16. O-ring
17. Check-valve
18.*a* End cap self piercing needle
18.*b* Chamber self piercing needle
19. Capsule
20. Hollow Rod
21. Suction line
22. Pump
23. Discharge line
24. Hollow rod bore
25. Nosepiece
26. Resilient Dome
27. Bumper guard
28. Check-valve
29. Affixed embodiment
30. Fluidchannel
31. Port
32. Swivel end tip
33. Bottoming screw
34. Gun barrel
35. Fluid collector
36. Open end 36 of the fluid collector 35
37. End cap
38. Cavity

I claim:

1. A gun barrel cleaner, comprising:

(a) A hollow handle with:
(i) an internal fluid chamber;
(ii) a front end;
(iii) a rear end;
(iv) a removable, leakproof cap, the removable leakproof cap being placed over the rear end of the hollow handle, the internal fluid chamber being sized for containing a capsule of fluid for cleaning a bore of a gun barrel;

(b) A manually operated suction-pressure pump on the handle for extracting and delivering fluid from the capsule in the internal fluid chamber into a hollow rod, and;

(c) the hollow rod having a first end and a second end, the first end of the hollow rod being inserted through the front end of the hollow handle.

2. The gun barrel cleaner of claim 1, further comprising a first check valve in the removable leakproof cap placed over the rear end of the hollow handle, the first check valve permitting air pressure to be equalized between the outside and the inside of the hollow handle.

3. The gun barrel cleaner of claim 2, further comprising a first hollow needle in communication with the first check valve, the first hollow needle being attached to the removable, leakproof cap and the first hollow needle piercing the wall of the fluid filled capsule placed in the internal chamber within the hollow handle.

4. The gun barrel cleaner of claim 3, further comprising a second hollow needle disposed within the internal chamber within the hollow handle so that the second hollow needle pierces a wall of the fluid filled capsule which is opposite from the wall of the fluid filled capsule which is pierced by the first hollow needle, the second hollow needle permitting cleaning fluid to pass from the fluid capsule to a suction line.

5. The gun barrel cleaner of claim 4, further comprising a second check valve located in the second end of the hollow rod.

6. The gun barrel cleaner of claim 5, further comprising a swivel end attached to the second end of the hollow rod.

7. The gun barrel cleaner of claim 6, further comprising a bumper guard over the front end of the hollow handle.

8. The gun barrel cleaner of claim 7, further comprising a fluid collector having an open first end and a second end, wherein the open first end is placed over an end of the gun barrel and the second end being closed by a removable cap.

9. A gun barrel cleaning system, comprising:

(a) A hollow handle with:
(i) an internal fluid chamber;
(ii) a front end;
(iii) a rear end;
(iv) a removable, leakproof cap, the removable leakproof cap being placed over the rear end of the hollow handle, the internal fluid chamber being sized for containing a capsule of fluid for cleaning a bore of a gun barrel;

(b) A manually operated suction-pressure pump on the handle for extracting and delivering fluid from the capsule in the internal fluid chamber into a hollow rod;

(c) the hollow rod having a first end and a second end, the first end of the hollow rod being inserted through the front end of the hollow handle;

(d) a bumper guard over the front end of the hollow handle (e) a first check valve in the removable leakproof cap placed over the rear end of the hollow handle, the first check valve permitting air pressure to be equalized between the outside and the inside of the hollow handle;

(f) a first hollow needle in communication with the first check valve, the first hollow needle piercing the wall of the fluid filled capsule placed in the internal chamber within the hollow handle;

(g) a second hollow needle disposed within the internal chamber within the hollow handle so that the second hollow needle pierces a wall of the fluid filled capsule which is opposite from the wall of the fluid filled capsule which is pierced by the first hollow needle, the second hollow needle permitting cleaning fluid to pass from the fluid capsule to a suction line;

(h) a second check valve located in the second end of the hollow rod;

(i) a swivel end attached to the second end of the hollow rod, and;

(j) a fluid collector having an open first end and a second end, wherein the open first end is placed over an end of the gun barrel and a second end is closed by a removable cap.

* * * * *